US006345459B1

(12) United States Patent
Martinez et al.

(10) Patent No.: US 6,345,459 B1
(45) Date of Patent: Feb. 12, 2002

(54) MERCHANDISE DISPLAY GUARD AND SEAL SYSTEM

(76) Inventors: Robert Martinez; Douglas Cotter, both of 6961 Hillcourt, Parker, CO (US) 80134

( * ) Notice: Subject to any disclaimer, the term of this patent is extended or adjusted under 35 U.S.C. 154(b) by 0 days.

(21) Appl. No.: 09/397,466

(22) Filed: Sep. 16, 1999

(51) Int. Cl.[7] ..... G09F 3/18

(52) U.S. Cl. ..... 40/642.02; 211/183; 40/121.19; 40/777

(58) Field of Search ..... 40/777, 760, 124.19, 40/642.01; 206/586, 453; 211/183, 184

(56) References Cited

U.S. PATENT DOCUMENTS

| | | | | |
|---|---|---|---|---|
| 1,322,380 A | | 11/1919 | Watts | |
| 1,715,237 A | | 5/1929 | Huston | |
| 2,050,791 A | * | 8/1936 | Graham | 206/521 |
| 3,422,556 A | | 1/1969 | Lyons et al. | |
| 3,824,720 A | | 7/1974 | Langwell | |
| 4,140,224 A | | 2/1979 | Celeste | |
| 4,546,943 A | | 10/1985 | Fast | |
| 4,713,899 A | | 12/1987 | Fast | |
| 5,272,826 A | | 12/1993 | Gingras | |
| 5,662,305 A | * | 9/1997 | Shimamura et al. | 248/500 |

* cited by examiner

*Primary Examiner*—Cassandra H. Davis
(74) *Attorney, Agent, or Firm*—Ramon L. Pizarro; Edwin H. Crabtree

(57) ABSTRACT

A merchandise display guard and seal system which uses a generally flat elongated flexible strip having a thickness and a pair of side edges defining a width, the width being substantially larger than the thickness. The strip includes a first fold line which is substantially parallel to one of the side edges and which provides a flexible section for dividing the strip into a sidewall section and a seal section; and a scored section, the scored section being at an angle to the first fold line and extending from one of the side edges, along the seal section towards the fold line, so that folding the strip along the first fold line and severing the scored section provides flexibility to the sidewall section, so that upon folding the sidewall section towards the seal section the sidewall section forms a concave boundary about the seal section.

17 Claims, 3 Drawing Sheets

MERCHANDISE DISPLAY GUARD AND SEAL SYSTEM

BACKGROUND OF THE INVENTION (a) Field of the Invention

This invention generally relates to an article of manufacture and a method for creating a merchandise display guard and sealing boundary. More particularly, but by way of limitation, to an edging strip that includes sections for creating a boundary to surround merchandise on display and to protect the merchandise from liquids that are frequently spilled on the floor of a store.

(b) Discussion of Known Art

Supermarkets and other similar stores typically display goods that are offered for sale in isles that allow the shopper to view the goods before purchase. To maximize the use of the floor, the isles are positioned in a generally parallel arrangement, with a larger walkway at the ends of the isles to allow shoppers to travel from one isle to the next. The isles provide an efficient system for displaying goods offered for sale, but often result in a small unused area of space at the end of each isle. This area of floor space is often used by storekeepers as the an area for the display of special items, such as seasonal items that are being offered at a discount and similar items.

To use the space at the ends of the isles, shopkeepers often stack items at the ends of the isles. The location at the ends of the isles offers advantages in that this area is highly visible since the ends of the isles will be seen every time a shopper moves from one isle to the next. To display items at these isle ends, shopkeepers often leave this area free of shelves, and then simply stack items over one another on the floor at the end of the isle. This arrangement offers advantages in that it allows the storekeeper to place a large quantity of items over a small area. Also, the end of an isle is a highly visible location since shoppers always travel around the end of the end of the isles to move from one isle to the next. Unfortunately, however, the placement of goods at the ends of isles, particularly goods that are sold in printed paperboard packaging, creates problems associated with cleanup of the display area. One such problem is caused by the fact that the floor of a store or market will typically be mopped at least once a day. Mopping requires that the wetting of the floor area around the merchandise on display. The water and other agents used to mop the floor inevitably find their way under the merchandise, damaging the packaging as well as the merchandise. As a result, the damaged packaging results in unmarketable merchandise. Also, the cleaning agents will also dry together with the damaged packaging material, causing the packaging material to stick to the floor. This dried material must then be scraped off the floor, involving significant amount of labor and expense to the merchant.

There are many known devices that are particularly useful for displaying flat panels with information such as price, brand, and other information that is useful to the consumer. For example, U.S. Pat. No. 5,272,826 to Gingras teaches the use of a display card holder that is made from a sheet of folded plastic material. While the Gingras device is certainly useful in addressing problems associated with supporting a display, it does not offer guidance as to how to take advantage of the area around the of a display isle and prevent damage to the goods or packaging of the goods on display.

Other devices are taught in U.S. Pat. Nos. 4,713,899 and 4,546,943 to Fast. The Fast inventions teach a simple system that is particularly well suited for supporting a display sign next to and from a shelf or other surface which contains apertures. Again, while these sign supports could be used at the end of an isle if the end of the isle provided the needed apertures. These devices are not effective in solving the problem of damage to merchandise due to the spreading of water and detergent while cleaning the aisles, for example.

Is Other known devices for supporting flat display signs around merchandise displays include U.S. Pat. Nos. 4,140,224 to Celeste 3,824,720 to Langwell, 3,422,556 to Lyons et al., 715,237 to Huston, and 1,322,380 to Watts. Some of these devices rely on the weight of the merchandise on display to support the device against the self. Other devices simply provide various structure that is useful for holding flat displays, such as price or advertisement displays against the shelf where items being offered are on display.

Thus, a review of known devices reveals that there remains a need for device and system for creating a merchandise display over a floor, particularly a smooth floor.

There remains a need for a merchandise display system which accommodates and conforms to the outline of the merchandise being displayed over the floor, and which prevents the seepage of fluids, such as water or detergent solutions to the floor area below the merchandise on display.

There remains a need for a system for creating a boundary about a floor display. The system being dispensable in user selectable lengths, so that the user may create a boundary about the display without being constrained by the shape of the perimeter of the merchandise over the floor.

SUMMARY

It has been discovered that the problems left unanswered by known art can be solved by providing a system for creating a boundary and seal about merchandise to be displayed over the floor of a store, the system including:

a) a generally flat elongated flexible strip having a thickness and a pair of side edges defining a width, the width being substantially larger than the thickness;

b) a first fold line along the strip, the first fold line being substantially parallel to one of the side edges and providing a flexible section for folding and dividing the strip into a sidewall section and a seal section, the sidewall section further comprising means for supporting the flat display;

c) a scored section, the scored section being at an angle to the first fold line and extending from one of the side edges, along the seal section towards the first fold line, so that upon folding the strip along the first fold line and severing the scored section provides flexibility to the sidewall section, so that upon folding the sidewall section towards the seal section the sidewall section forms a concave boundary about the seal section.

It has been discovered that the disclosed structure can be dispensed in rolls, allowing the end user to cut off or break off a desired length of the strip to form a boundary about the merchandise display. Accordingly, the disclosed structure allows the end user to form a seal about the perimeter of the display by cutting off a desired length of the strip, then defining the perimeter of the display by positioning items to be displayed over the seal portion of the strip. The scored areas along the seal portion of the strip will allow the user to sever the strip at selected locations along the seal portion to then allow forming a perimeter of the strip about the display.

Additionally, it will be understood that according to a highly preferred embodiment of the invention the sidewall section will provide support for displays. Thus the sidewall portions will allow the user to place display signs along the sidewall portions. It is contemplated that these display signs will be used to inform the consumer about the price, source, and other important features concerning the items on display.

According to a highly preferred embodiment of the invention, the display support in the sidewall section will be conveniently formed by providing creased or fold areas along the sidewall portion to allow the user to fold the sidewall portion. In a highly preferred embodiment of the invention, these fold areas will be generally parallel to the fold area that allows folding of the stip into a seal portion and a sidewall portion.

Still further, according to a highly preferred embodiment of the invention, the sidewall portion will include collapsible stiffeners or members with provide rigidity to the sidewall portion. In one preferred embodiment of the invention these stiffeners consist of a fold line that allows folding of the edge of the sidewall portion towards the seal portion in order to enhance the overall rigidity of the structure.

It should also be understood that while the above and other advantages and results of the present invention will become An apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
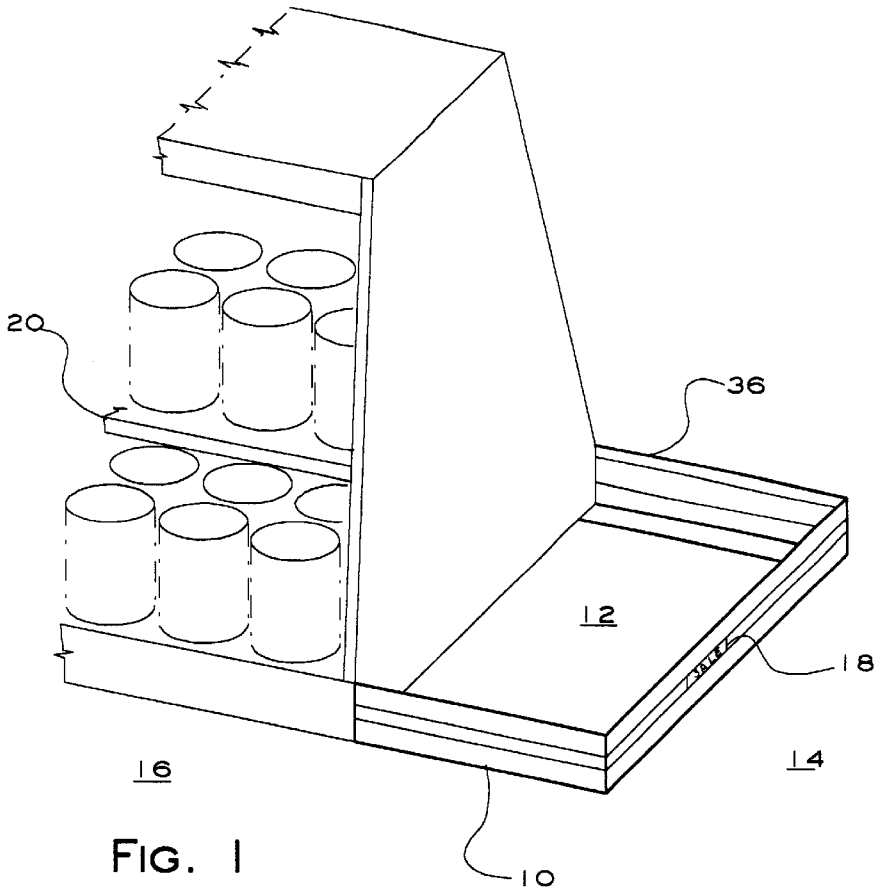
FIG. 1 is a perspective view of an embodiment of the invention used to create a merchandise display area over the floor of a walkway are at the end of a display shelf or isle in a grocery store.

Turning now to FIG. 1 where a merchandise display guard 10 and seal system manufactured in accordance with the principles taught herein has been illustrated. As illustrated on FIG. 1, the display guard 10 is particularly well suited for isolating an area 12 over a floor section 14 on a walkway 16 and for supporting a flat display sign 18. Also shown on FIG. 1 is that the display guard 10 is particularly well suited for forming a generally concave boundary or perimeter which will surround the merchandise to be displayed at the end of an aisle defined by display shelves 20, for example.

Figure 2:
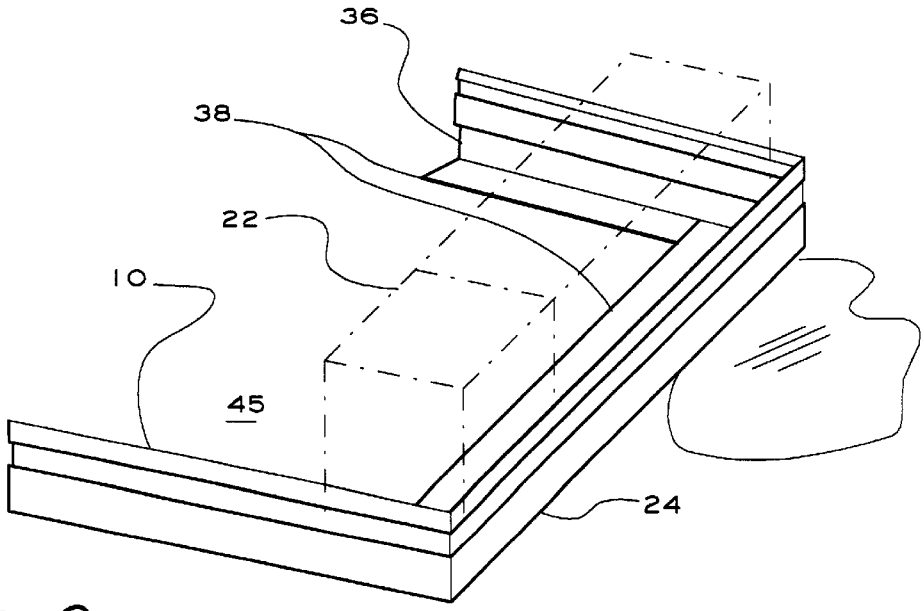
FIG. 2 is a perspective view of a highly preferred embodiment of the invention, the view illustrating the positioning of merchandise within the concave area of the invention to seal off and define a display area.

Turning now to FIG. 2, where the exterior form or shape of merchandise or display products 22 has been shown mounted within the perimeter 24 formed with the display guard 10. The products 22 will preferably rest over a seal portion 26 formed with the display guard 10.

Figure 3:
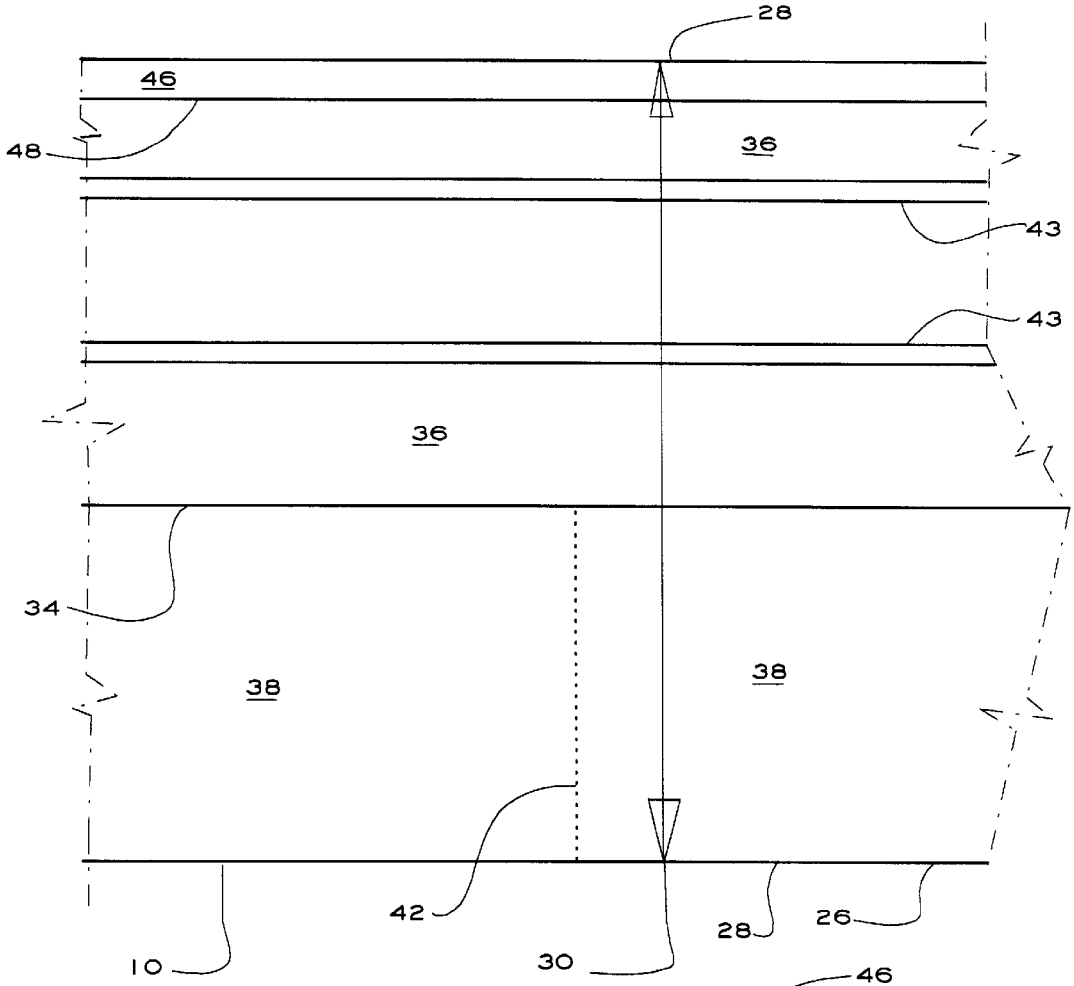
FIG. 3 is a plan view of a strip or section of a highly preferred embodiment of the invention. The view illustrating the fold lines to be used for forming the various sections of the invention.
Figure 4:
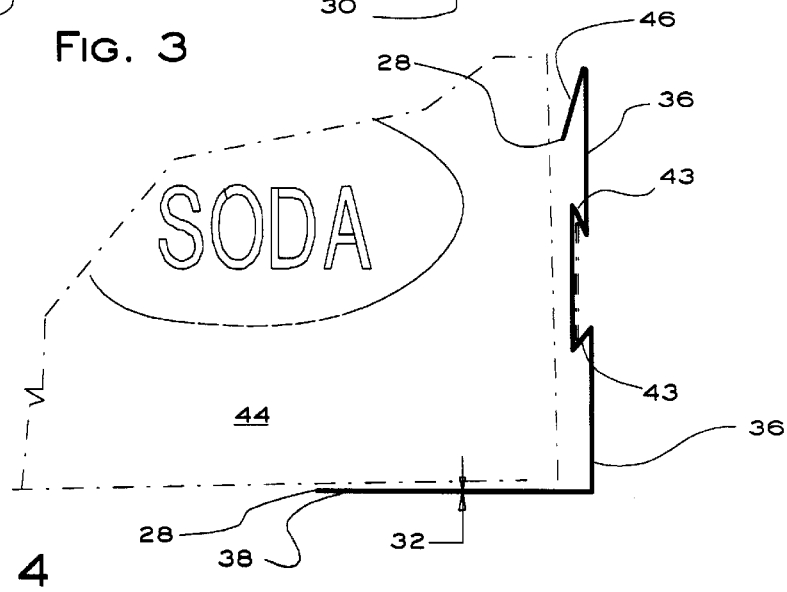
FIG. 4 is a section cut taken at the location and along orientation shown on FIG. 2.

Turning now to FIGS. 3 and 4 it will be understood that in a highly preferred embodiment of the invention the display guard 10 will be formed from a generally flat elongated flexible strip 26. As shown in these figures is that the flexible strip 26 a pair of side edges 28 which will define a width 30 of the strip 26. Also, the strip 26 will be of a thickness 32, and the width 30 of the strip 26 will be substantially larger than the thickness 32 of the strip 26. The strip 26 will preferably include a first fold line 34 along the strip 26. According to a highly preferred embodiment of the invention, the first fold line 34 is substantially parallel to one of the side edges 28. The first fold line will preferably be formed as a crease or thinned area of reduced stiffness that provides a flexible section for folding the strip 26 and dividing the strip 26 into a sidewall section 36 and a seal section 38 or portion.

Figure 4A:
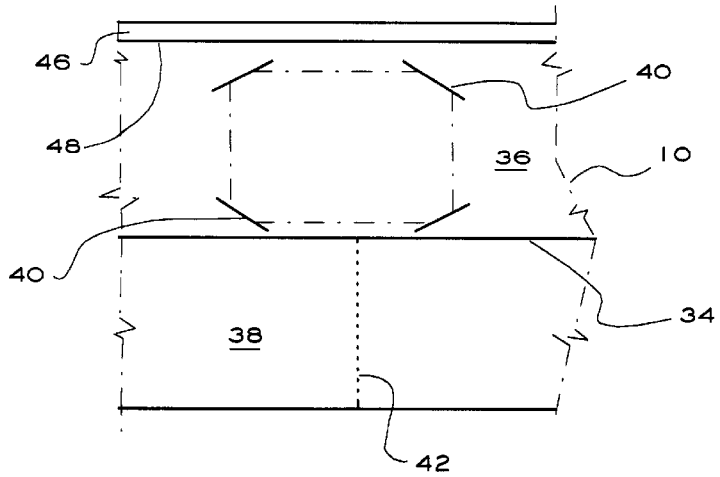
FIG. 4A illustrates an alternative flat display support.
Figure 4B:
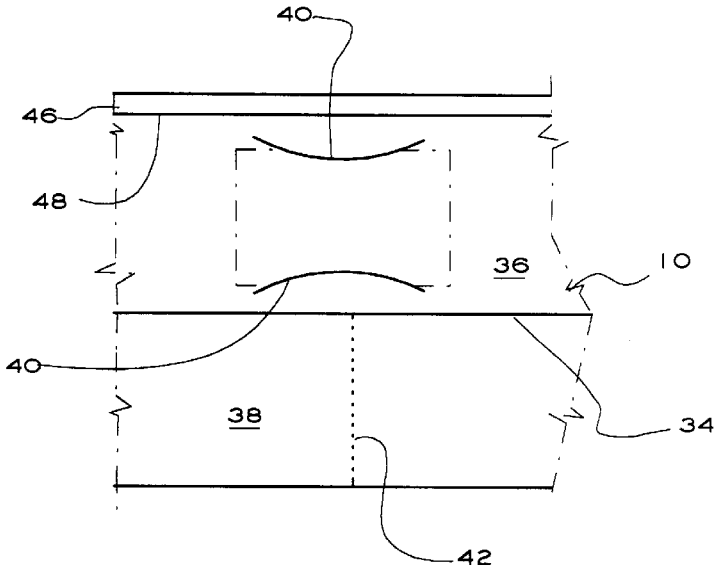
FIG. 4B illustrates yet another alternative flat display support.
Figure 5:
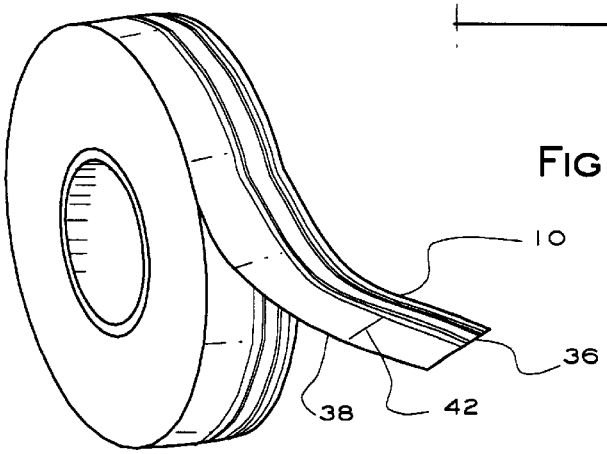
FIG. 5 illustrates the dispensing of the invention as a rolled strip.

As shown in FIG. 4, the sidewall section 36 includes means for supporting the flat display 18. According to a highly preferred embodiment of the invention, these means for supporting the flat display consist of a pair of opposing sections 40 with openings 42 for supporting the flat display 18. In a preferred embodiment of the invention, each opposing section 40 is defined by a pair of folded areas, each having a generally Z-shaped cross-section 43 as shown on FIG. 4. It is important to note, however, that it is contemplated that these opposing sections 40 may be made from scored or cut-out portions which can accommodate the corners or edges of the flat displays. For example, referring to FIG. 4A, it will be understood that the cutouts may consist of generally semicircular cutouts that accept the edges of the generally flat display 18. Alternatively, as shown on FIG. 4B, the cutouts that support the flat display 18 consist of slits that accept the corners of the flat display 18.

Referring once again to FIG. 3, it will be understood that in a highly preferred embodiment of the invention the strip 26 will include a scored section 42 that is at an angle, preferably at a right angle, to the first fold line 34. The scored section 42 will preferably extend along the seal section 38 from one of the side edges 28 and extend towards the first fold line 34. The scored section 38 will allow tearing or folding into generally dart shaped sections of the seal section 38. By folding or tearing the seal section 38, the user will be able to contour or shape the display guard 10 so that the display guard 10 forms a generally concave area or bay that surrounds the merchandise on display. It is contemplated that to obtain the desired performance or use of the disclosed invention, the seal section 40 should extend towards the concave area 45 as shown on FIGS. 1 and 2, for example. By allowing the seal section 38 to extend towards the concave area 45, one allows the seal section 38 to act as a ledge area on which the items to be displayed 44 are placed.

As can be understood from illustration on FIG. 4, the weight of the items to be displayed 44 bears on the seal section 38 and cooperates with the seal section 38 to effectively block or seal off the concave area 45. By sealing off the concave area 45 the disclosed invention creates a protected area which allows the stacking of additional items to be displayed. Importantly, the seal section 38 will protect the items to be displayed 44 from water or detergents that are inevitably dispersed over the floor 14 during routine maintenance of the store or market where the items are being sold.

To enhance the sealing function carried out by the disclosed invention, it is contemplated that the generally flat elongated flexible strip 26 will be made is made from a resilient material, such as a flexible plastic, so that the seal portion will deflect and conform to the floor surface in response to the positioning of the display item, item to be displayed 44, over the seal section 38.

Referring once again to FIG. 4, it will be understood that it is also contemplated that an additional stiffener, which may be formed as a planar stiffener section 46 projecting from the sidewall section 36, may be incorporated in the disclosed invention. According to the preferred embodiment illustrated in FIG. 4, it is contemplated that this stiffener section 46 may simply be formed by incorporating a stiffener fold line 48 folding the sidewall section in the direction of the concave form of the seal portion. It is important to note that it is also contemplated that the stiffener may be embodied as a separate attached or attachable section. However, the preferred embodiment of the invention incorporates a stiffener formed as an integral section of the strip 26. This integral fabrication allows the manufacture and dispensing of the invention in roll form, allowing the user to cut off a desired length of the display guard 10 to form the barrier around the items on display, and then form the display by stacking additional items within the area encircled or enclosed by the display guard. It should also be understood that while it is contemplated that the disclosed invention will be used to form display areas at the end of shelving or aisles, it is also contemplated that the material or display guard 10 may be used to form completely enclosed areas, the concave area being completely surrounded or enclosed with the display guard 10.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A merchandise display guard and seal system comprising:

a generally flat elongated flexible strip of a resilient material, the generally flat elongated flexible strip having a thickness and a pair of side edges defining a width, the width being substantially larger than the thickness;

a first fold line along the strip, the first fold line being substantially parallel to one of the side edges and providing a flexible section for dividing the strip into a sidewall section and a seal section; and a scored section, the scored section being at an angle to the first fold line and extending from one of the side edges, along the seal section towards the fold line, so that folding the strip along the first fold line and severing the scored section provides flexibility to the sidewall section, so that upon folding the sidewall section towards the seal section the sidewall section forms a concave boundary about the seal section.

2. A system according to claim 1 wherein said first fold line consists of an area of reduced stiffness.

3. A system according to claim 1 wherein said sidewall section further comprises means for supporting a flat display.

4. A system according to claim 1 and further comprising a generally planar stiffener section projecting from said sidewall section.

5. A system according to claim 1 and further comprising means for supporting a flat display, said means for supporting a flat display being integral with the sidewall section, and means for stiffening the sidewall section, the means for stiffening the sidewall section being substantially parallel to the first fold line.

6. A merchandise display guard and seal system for isolating an area over a floor section on a walkway and for supporting a flat display sign, the system comprising:

a generally flat elongated flexible strip having a thickness and a pair of side edges defining a width, the width being substantially larger than the thickness;

a first fold line along the strip, the first fold line being substantially parallel to one of the side edges and providing a flexible section for folding and dividing the strip into a sidewall section and a seal section, the sidewall section further comprising means for supporting the flat display;

a scored section, the scored section being at an angle to the first fold line and extending from one of the side edges, along the seal section towards the first fold line, so that upon folding the strip along the first fold line and severing the scored section provides flexibility to the sidewall section, so that upon folding the sidewall section towards the seal section the sidewall section forms a concave boundary about the seal section.

7. A system according to claim 6 wherein said first fold line consists of an area of reduced stiffness.

8. A system according to claim 6 wherein said means for supporting a flat display comprises a pair of opposing cutout portions.

9. A system according to claim 6 wherein said means for supporting a flat display comprises a pair of opposing sections, each opposing section having a generally Z-shaped cross-section.

10. A system according to claim 7 and further comprising a generally planar stiffener section projecting from said sidewall section.

11. A system according to claim 10 wherein said stiffener section is formed by folding the sidewall section in the direction of the concave form of the seal portion.

12. A method for creating a merchandise display over a floor surface formed for providing a walk area for people, the method comprising:

providing a merchandise display guard and seal comprising:

a generally flat elongated flexible resilient strip having a thickness and a pair of side edges defining a width, the width being substantially larger than the thickness, said generally flat elongated flexible strip is made from a resilient material, go that the seal portion will deflect and conform to the floor surface in response to the positioning of a display item over the seal portion;

a fold line along the strip, the fold line being substantially parallel to one of the side edges and providing a flexible section for dividing the strip into a sidewall section and a seal section; and a scored section, the scored section being at an angle to the fold line and extending from one of the side edges, along the seal section towards the fold line;

folding the strip along the fold line; severing the scored section provides flexibility to the sidewall section;

bending the sidewall section towards the seal section so that the sidewall section forms a concave boundary about the seal section;

placing the seal section over the floor surface; and placing merchandise over the seal section and within the concave boundary.

13. A method according to claim 12 wherein said first fold line consists of an area of reduced stiffness.

14. A method according to claim 13, and further comprising a support for a flat display the support for a flat display comprising a pair of opposing cutout portions.

15. A method according to claim 12 and further comprising a support for a flat display the support for a flat display a pair of opposing sections, each opposing section having a generally Z-shaped cross-section.

16. A method according to claim 12 and further comprising a generally planar stiffener section projecting from said sidewall section.

17. A method according to claim 16 wherein said stiffener section is formed by folding the sidewall section in the direction of the concave form of the seal portion.

* * * * *